US006105330A

United States Patent [19]

Nanayakkara

[11] Patent Number: 6,105,330

[45] Date of Patent: Aug. 22, 2000

[54] CONSTRUCTIONAL COMPONENTS FOR USE IN A WALL STRUCTURE

[76] Inventor: Lakdas Nanayakkara, 2211 NE. 54th St., Fort Lauderdale, Fla. 33308

[21] Appl. No.: 08/924,517

[22] Filed: Sep. 5, 1997

[51] Int. Cl.[7] ..... E04B 1/04

[52] U.S. Cl. ..... 52/606; 52/604; 52/590.2; 52/592.6

[58] Field of Search ..... 52/590.2, 592.6, 52/591.1, 604, 606

[56] References Cited

U.S. PATENT DOCUMENTS

| | | | |
|---|---|---|---|
| 2,902,853 | 9/1959 | Lofstrom | 52/590.2 X |
| 3,305,982 | 2/1967 | Steele | 52/590.2 X |
| 3,325,956 | 6/1967 | Moraetes | 52/606 |
| 3,382,632 | 5/1968 | Grofcsik | 52/606 |
| 5,279,083 | 1/1994 | Savorani | 52/590.2 X |

*Primary Examiner*—Christopher T. Kent
*Attorney, Agent, or Firm*—M K Silverman

[57] ABSTRACT

A constructional component for a wall structure capable of resisting high gravity and lateral loads, both uniform and cyclical, is defined by a partially hollow building block having a generally solid rectangular exterior configuration in which one entire end surface of the building block exhibits a positive deep key geometry and the opposing end surface exhibits a negative deep key geometry, complemental to the positive geometry of the opposite end. Deep key interlocks also exist between opposing horizontal block surface. As partition between vertical cavities of the block narrows in the negative vertical direction. There is resultingly created a substantially rigid and load-resilient interlock between vertical and horizontal complemental surfaces when joined as components of a wall structure.

8 Claims, 9 Drawing Sheets

10

CONSTRUCTIONAL COMPONENTS FOR USE IN A WALL STRUCTURE

REFERENCE TO RELATED APPLICATION

This case is a substitute for application Ser. No. 08/142,059, filed Oct. 28, 1993, entitled Constructional Components for Use in a Wall Structure.

BACKGROUND OF THE INVENTION

1. Field of Invention

The present invention relates to interlocking building blocks for the construction of a building or wall structure.

It is common construction practice to erect building walls, as well as certain categories of free-standing walls, using concrete blocks of a solid rectangular configuration in which each block exhibits a plurality of cavities and external planes at all six sides thereof. Such blocks are, as is well known, laid-up in courses, typically by placing mortar, by trowel, on the top of the blocks and then positioning the blocks of the next course upon the lower course. However, as described below, some systems of interlocking blocks exist which reduce or eliminate the need for such mortar. The instant invention particularly addresses the need for building blocks useful components of an interlocking building block system capable of resisting high lateral loads, of a both uniform and cyclical nature.

2. Description of the Prior Art

The prior art has recognized the need for, and value of, a building block system having interlocking elements at the horizontal interface between courses of the building blocks. The rationale for the use of such interlocking between horizontal planes of building blocks has, typically, been to eliminate or minimize the need for mortar between the courses thereof.

Such structures and systems appear in the prior art as U.S. Pat. Nos. 4,186,540 (1980) to Mullins, entitled Interlocking Cementitious Building Blocks and No. 3,325,956 (1967) to Moraetes, entitled Key Element for Concrete Blocks.

All building blocks of the instant type include a solid volume, also known as a web, which separate two vertical cavities. In the instant invention, this solid volume or web narrows in the negative (downward vertical) direction. No such narrowing of the web or partition exists in the reference to Mullins. Rather, it is only the upper mouth, known as a corbel, which slopes in a negative z-direction. More particularly, the teaching of Mullins is limited to that of a shape of the mouth of the vertical cavities which assists in the removal of retractable cores therefrom after the molding of such a block has occurred. Accordingly, to the extent that any narrowing of the web or partition Mullins occurs in the negative direction, such narrowing plays no role in the functionality of any wall system formed of blocks thereof.

With respect to Moraetes cited above, the teaching thereof is that of core openings which are tapered to permit ready extraction of the cores of molds thereof during manufacture of the block. That is, the vertical cavities of Moraetes do not bear any particular relationship to the structure of the webs or partition separating the vertical cavities thereof. Rather, the teaching of Moraetes relates only to its use of so-called key sections, which use is facilitated by the core openings shown therein. As such, the system of Moraetes is one is which a separate key or lock element, having completely different mechanical principles from that of Applicant's system, is used to achieve some of the objectives of vertical and horizontal stability set forth herein. It is therefore to be appreciated that a system of the type of Applicant's cannot be achieved by Moraetes, either alone or in combination with any other art known to the within inventor. Further, the art of record does not suggest the particular location of the interior cavity ledges of the component block structure of this invention. Without the particular geometry of the ledge structure of the vertical cavity walls of the inventor's constructional components it is not possible to achieve wall structures which are structural or functional equivalents of those that can be constructed with inventor's constructional components, this as is more particularly set forth below.

The inventor is also aware of United Kingdom Patent No. 550,745 (1941) to Rigby which teaches a proportionality of interlock elements which is completely different from that of the present invention. More particularly, Rigby, as is the case in essentially all prior art known to the inventor, is lacking in the deep key interlock features of the invention which are set forth herein.

It is further noted that none of the above prior art addresses or suggests the need or value of a building block interlock structure between the vertical surfaces of building blocks within courses or rows, apparently because of a lack of recognition of the need for structures that could provide resistance against unusual lateral loads that might be encountered by a wall structure formed of building blocks. However, the extent to which the forces of nature can impact upon the integrity of apparently massive structures, such as building blocks/masonry wall structures, as been long know to architects and structural engineers that have been active in geographical areas prone to high velocity winds and earthquakes. High lateral loads may, as well, result from the horizontal component of truss-type loading upon a wall which is in truss-like communication with roof-beams and other transverse members of a given mechanical system.

The instant invention, accordingly, addresses the long-felt need in the art for a constructional component adapted for use in a wall system capable of resisting such high lateral loads, regardless of the origin thereof.

SUMMARY OF THE INVENTION

The present invention is a constructional component for a wall structure capable of resisting high lateral loads, both uniform and cyclical. The inventive component comprises a building block having a generally solid rectangular exterior configuration definable by an xyz Cartesian coordinate system, an x-axis thereof comprising a width axis of said wall structure, a y-axis thereof comprising the directionality of the wall structure, and a z-axis thereof comprising a vertical axis of the wall structure, in which one xy end surface of each building block comprises a positive y-axis deep key geometry and each opposing xz end surface comprises a negative y-axis deep key geometry complementally interlockable to said positive geometry of said opposite xz end surface in which a y-axis deep key dimension of said respective positive and negative deep key geometries comprises in a range of about eight to about twenty five percent of the x-axis dimension of said block, in which said block includes a plurality of vertical cavities extending the entire z-axis length therethrough, said cavities separated by a web portion having respective non-parallel opposing vertical surfaces thereof which narrow relative to each other in the negative z-axis direction, said cavities further having interior ledges at their interface with respective top and bottom xy surfaces of said block, said ledges defining respectively negative and positive complementally interlockable structures, each having a z-axis dimension in a range of about eight to about twenty-five percent of the x-axis dimension of the block.

It is accordingly an object of the invention to provide a building block suitable for use as a constructional component of the wall structure adapted for resistance to high lateral loads, both uniform and cyclical.

It is another object to provide a constructional component of a wall system particularly adapted to resist lateral loads resultant from earthquakes, hurricanes, or predefined lateral loads within a truss system.

It is a further object of the invention to provide a constructional component providing enhanced resistance to high lateral loads in both the vertical and horizontal planes of interlock between such constructional components.

It is a yet further object to provide a constructional component of the above type wherein the topmost course of a wall thereof may be readily secured to the roof of a building.

It is a still further object of the invention to provide a constructional component of the above type having a substantially reduced mortar requirement between the horizontal interlock surface thereof.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

With reference to the views of FIGS. 1 to 5, there is shown a first embodiment of a constructional component in accordance with the instant invention. There is, more particularly, shown the overall solid rectangular configuration of a constructional component 10, which configuration includes hollow internal z-axis cavities 12 and 14, and yz-plane front and back vertical faces 16 and 17. It may, from said figures, be noted that the inventive constructional component 10 does not differ from prior art constructional components in its provision of either said z-axis cavities 12 and 14 or in its provision of planar front and back vertical faces 16 and 17. Rather, its differences, as compared to the prior art, reside in those interlocking features described below.

Figure 1:
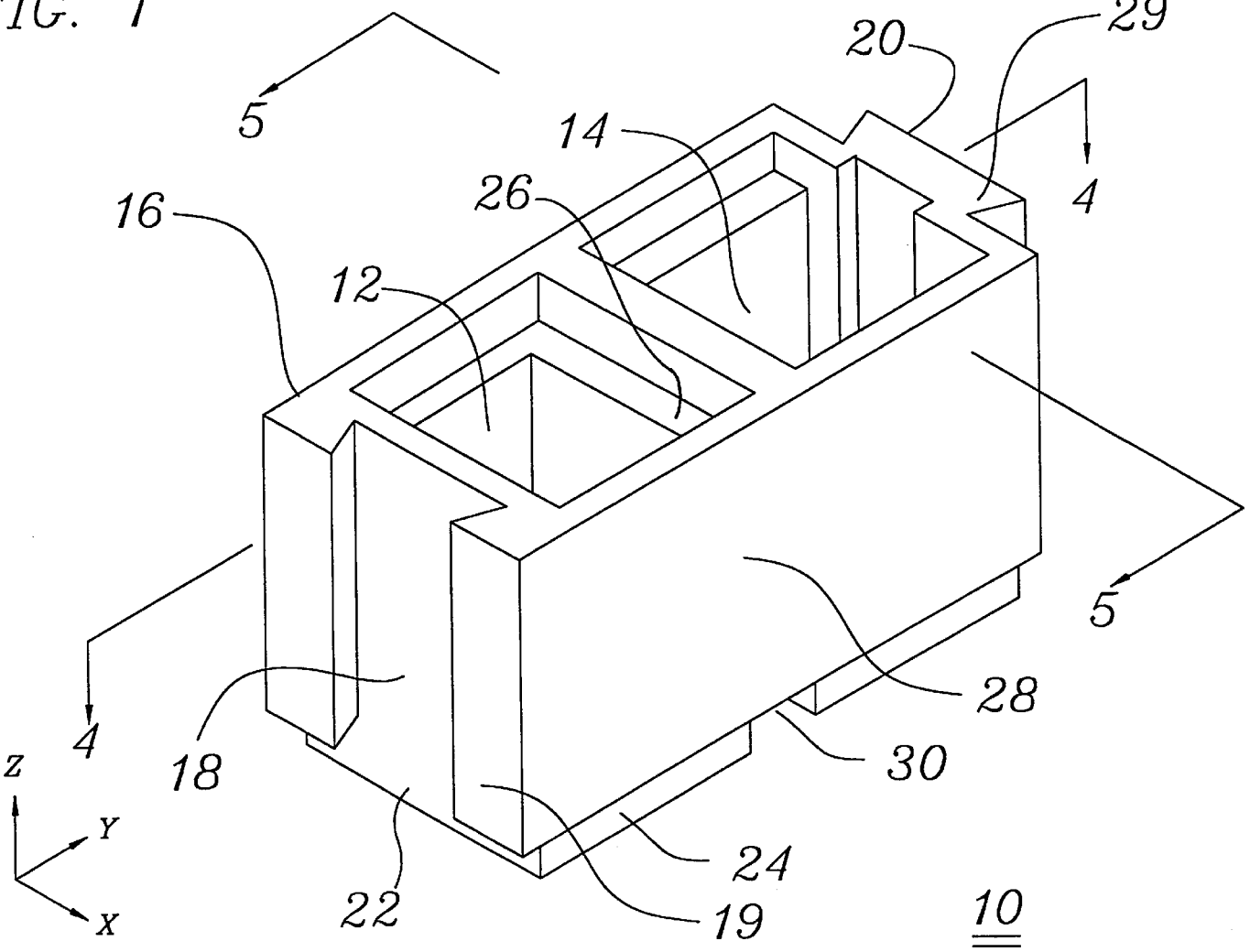
FIG. 1 is an isometric view of an outward trapezoidal embodiment of the inventive constructional block.
Figure 2:
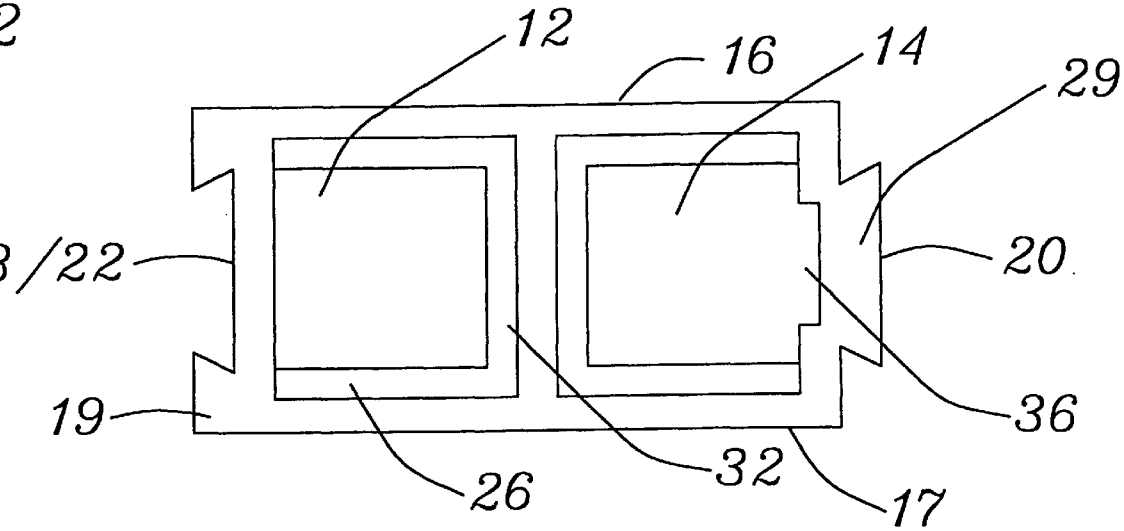
FIGS. 2 and 3 are respective top and bottom plan views of the embodiment of FIG. 1.
Figure 3:
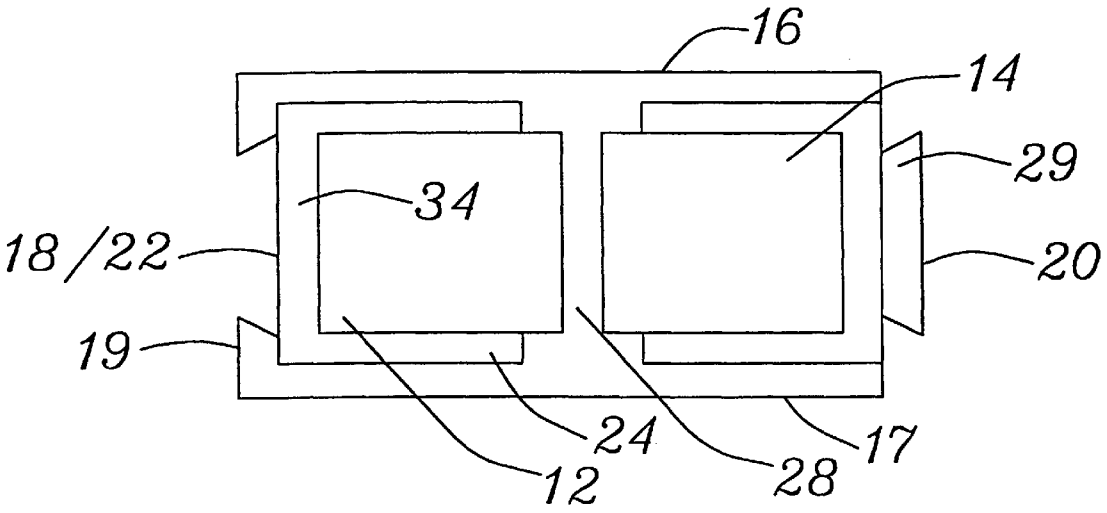
Figure 5:
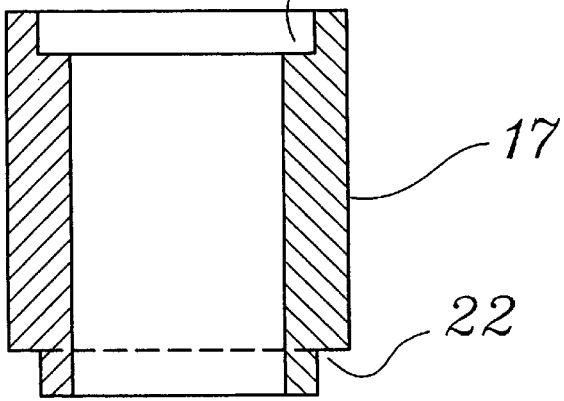
FIG. 5 is a vertical cross-sectional view taken through Line 5—5 of FIG. 1.
Figure 4:
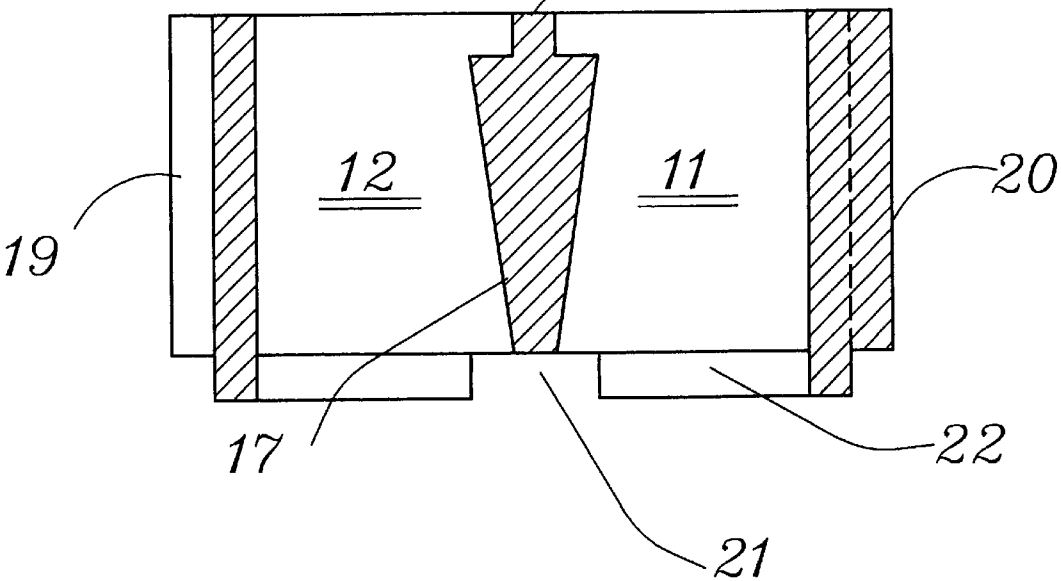
FIG. 4 is a vertical cross-sectional view taken along Line 4—4 of FIG. 1.

The constructional component 10 is more particularly characterized in its provision, along left and right xz plane end surfaces 18 and 20 with so-called deep key geometries in which the xy geometry of xz surface 18 is complemental to the xy geometry of xz surface 20 such that when components of the type of FIG. 1 are fitted to each other, a strong interlock between the negative deep key geometry of surface 18 and the positive deep key geometry of surface 20 will exist. See FIG. 7. It is noted that the particular deep key geometry shown in relation to surface 18 is termed an inward trapezoid. The y-axis depth of the deep key geometry of surfaces 18 and 20 may be more clearly seen with reference to the top and bottom views of FIGS. 2 and 3 respectively. It may be noted that the ratio of the dimension of y-axis recess 22 of the negative key portion of surface 18 to the entire y-axis width of the building block is approximately 0.15. Conversely, the ratio of positive projection 29 to the y-axis length of the block is about 0.15. Accordingly, it may be appreciated that the recess 22 of negative deep key surface 18 and protrusion 29 of positive deep key surface 20 constitute a substantial portion (about 30%) of the y-axis length of the constructional component 10.

The y-axis dimension of recess 22 of surface 18 and projection 29 of surface 20 are, more importantly, definable relative to the x-axis width of the constructional component 10. That is, the dimensions of recess 22 and projection 29 are each approximately thirteen percent of the x-axis width of the component 10, with a range of eight to twenty-five percent being usable. Accordingly, the interlock achievable upon assembly of components 10 into the form of a masonry block wall 40, of the type shown in FIG. 7, will be one having substantially greater resistance to high lateral loads, that is, x-axis loads, than is the case in those blocks known in the prior art in which such a ratio of total y-axis interlock length to x-axis dimension of the block is not taught.

The function of keyway 36 (see FIGS. 1 and 2) is simply to reduce weight of the structure. The depth of the keyway may be in the range of 8–20 percent of the x-axis width of the block.

It is further noted that the respective recesses 22 and protrusions 29 are also definable in terms of their ratio of x-axis dimension to the x-axis width of each block 10. More particularly, a base of surface 18 or protrusion 20 will comprise at least fifty percent of the entire x-axis width of the block. This parameter operates to further increase the resistance of the block wall 40 to high x-axis or lateral loads.

To provide a constructional component having yet greater resistance to such high lateral loads, a somewhat corresponding deep key interlock may be provided to lower positive and upper negative xy ledges 24 and 26 respectively of the block 10 which are separated by vertical partition 28 and lower channel 30. See FIGS. 1 and 3. Therein, it may be seen that the lips of said z-axis cavities 12 and 14 comprise said ledges 24 and 26 each having approximately the same dimensions relative to the x-axis width of the constructional block 10 as said dimensions of recess 22 and projection 29 of said xz vertical surfaces 18 and 20 respectively of the block, i.e., 8 to 25% of the x-axis width. It is noted that each of said ledges are three-sided and, unlike prior art ledges, are formed integrally with the partition walls of each block 10. Also, as may be noted in FIGS. 2 and 3, center xy upper ledge 32 does not have a corresponding lower ledge and center xy lower ledge 34 does not have a corresponding upper ledge.

As may be appreciated, the benefit of adding the so-called deep key interlocks to the positive and negative ledges 24 and 26 of cavities 12 and 14 lies in the provision of an additional x-axis to the system of interlock. The resulting resistance to lateral (x-axis) loads is clearly far greater in such a constructional element which employs deep key interlocks in both xy and xz planes. Particularly, as is apparent to those of skill in the art, it would be an unusual loading or stress situation in which a lateral (x-axis) load were not combined with a loading component in either or both the y- and z-axes. Where a wall structure resultant from use of constructional components constitutes a part of a truss-like system, such as a building having walls with a roof thereupon, the components of loading may be well-known in advance. Further, in phenomena of nature, such as an earthquake or hurricane, to which a wall structure may become subject, it is most probable that powerful y- and z-axis components of stress and pressure will also be felt. Accordingly, a vertical load-resistive system effective only against x-axis loading, in combination with loading components of only one other axis, would be or relatively little value. Accordingly, the embodiment of the invention shown in the isometric view of FIG. 1 affords significant resistance to all lateral loads, both uniform and cyclical, whether combined with y-axis components, z-axis components, or both.

It is to be appreciated that, while the aforesaid deep key dimensions 22, 24, 26 and 29 are, in the preferred embodiment, about thirteen percent of the x-axis dimension of the constructional component, any dimension in excess of about eight percent will, as above noted, serve the purpose of the instant invention. That is, in situations where greater lateral load resistance is desired, for example, in a wall structure that is part of a truss system having a high pre-determined lateral loading, one may enlarge the y-axis "deep key" dimension to about twenty-five percent of the x-axis dimension of the block.

It is noted that, as an additional benefit of the instant invention, the use of mortar between horizontal surfaces of a wall structure formed in accordance with the present invention may be reduced from a normal thickness of ⅜ inch to one of about ⅛ inch, particularly when a state-of-art elastomeric type of bonding material is employed within the ledges 24 and 26 of the vertical cavities 12 and 14.

With further reference to the views of FIGS. 1 thru 5, it is shown that the central partition 28 between left and right vertical cavities 12 and 14 exhibits a taper in the negative z-axis. In other words, the z-axis dimension of partition 28 becomes increasingly narrower from top to bottom of block 10.

Figure 6:
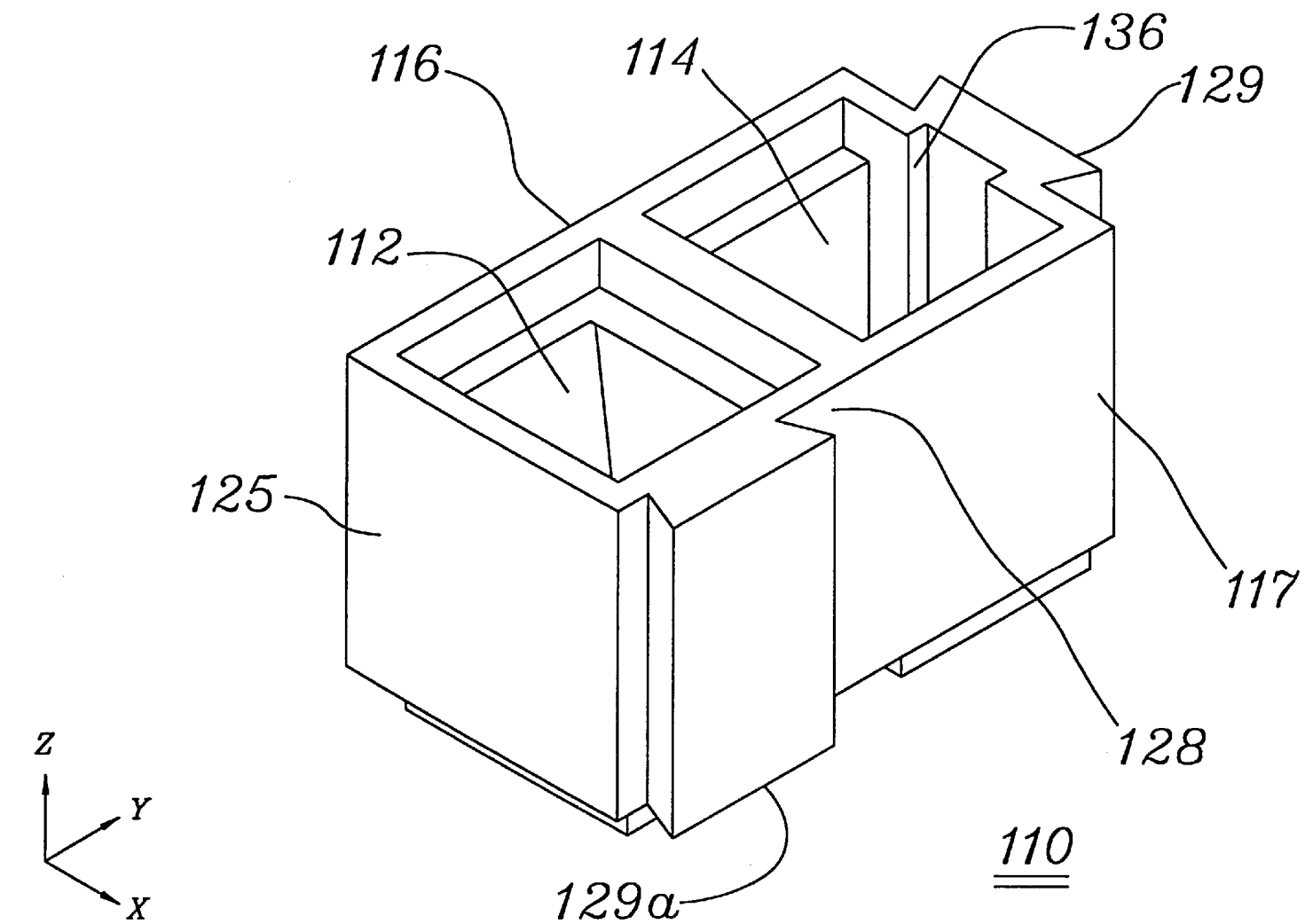
FIG. 6 is an isometric view of a further embodiment of the invention.

With reference to FIG. 6, there is shown a further embodiment of the invention, i.e., block 110, in which a left xz end face 125 is planar, while a back yz face 117 is provided with a male projection 129*a* which is conformal with that of projection 129 of the rear yz face of the block 110. Said block further includes partitions 112 and 114, front yz face 116.

Figure 7:
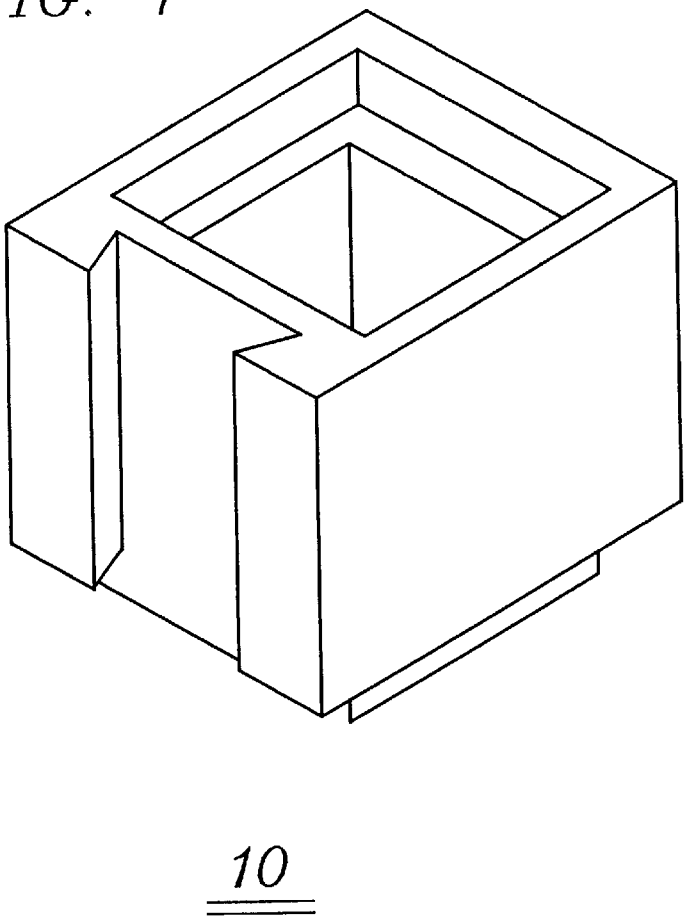
FIG. 7 is a perspective view of a wall structure resultant from the use of the embodiments of the blocks of FIGS. 1 and 6, showing the use of a running course thereof.

In FIG. 7 is shown a wall 40 constructed of said blocks 10 and 110.

Figure 8:
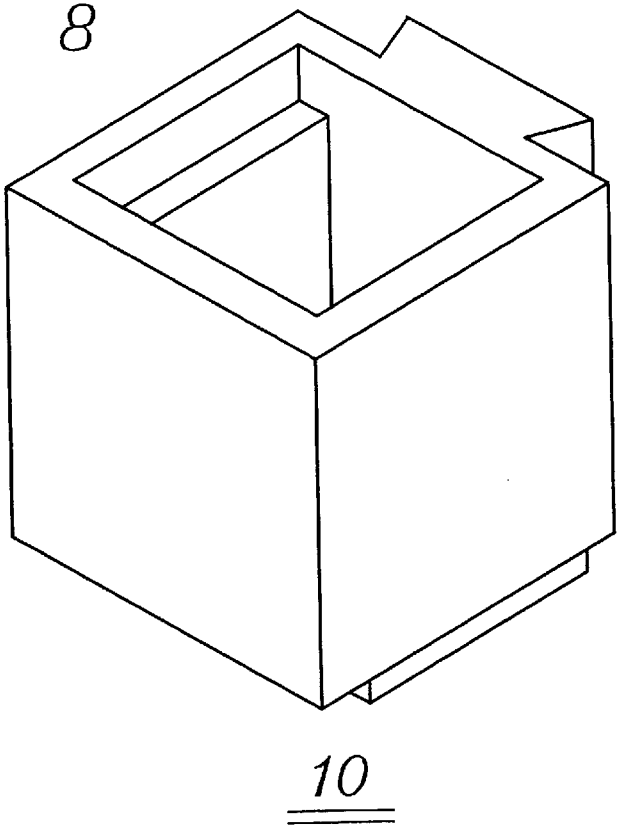
FIG. 8 is a vertical cross-sectional view of the right side of the wall shown in FIG. 7.

FIG. 8 is a vertical cross-sectional view of the right part of wall 40 of FIG. 7.

Figure 9:
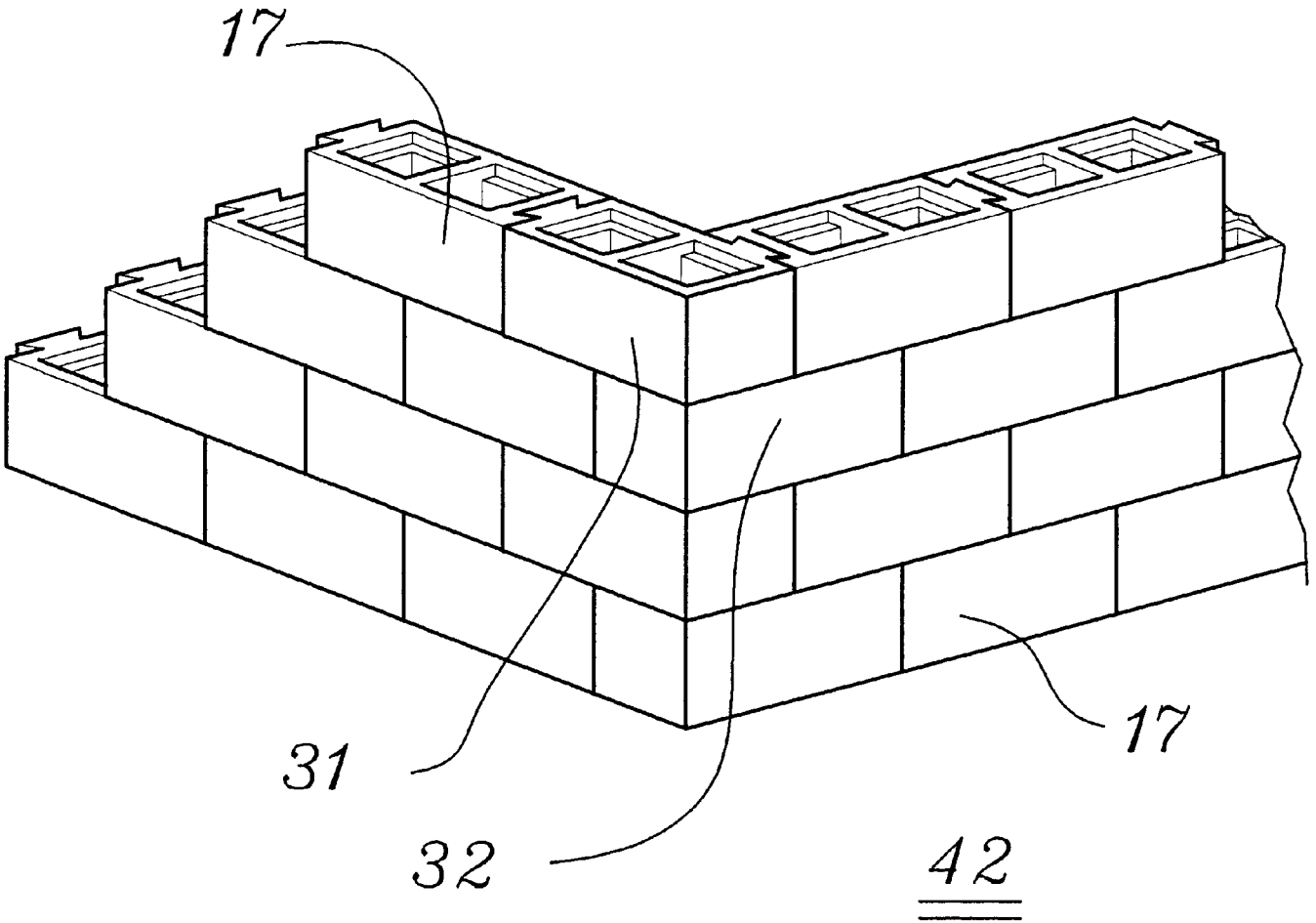
FIG. 9 is a perspective view of a wall structure resultant of the use of the block of the embodiment of FIG. 1 of the invention showing the manner in which the instant invention may be used in association with steel rebars to form window and arch-like structures.

FIG. 9 shows use of the inventive block in a wall system having openings therein.

Figure 10:
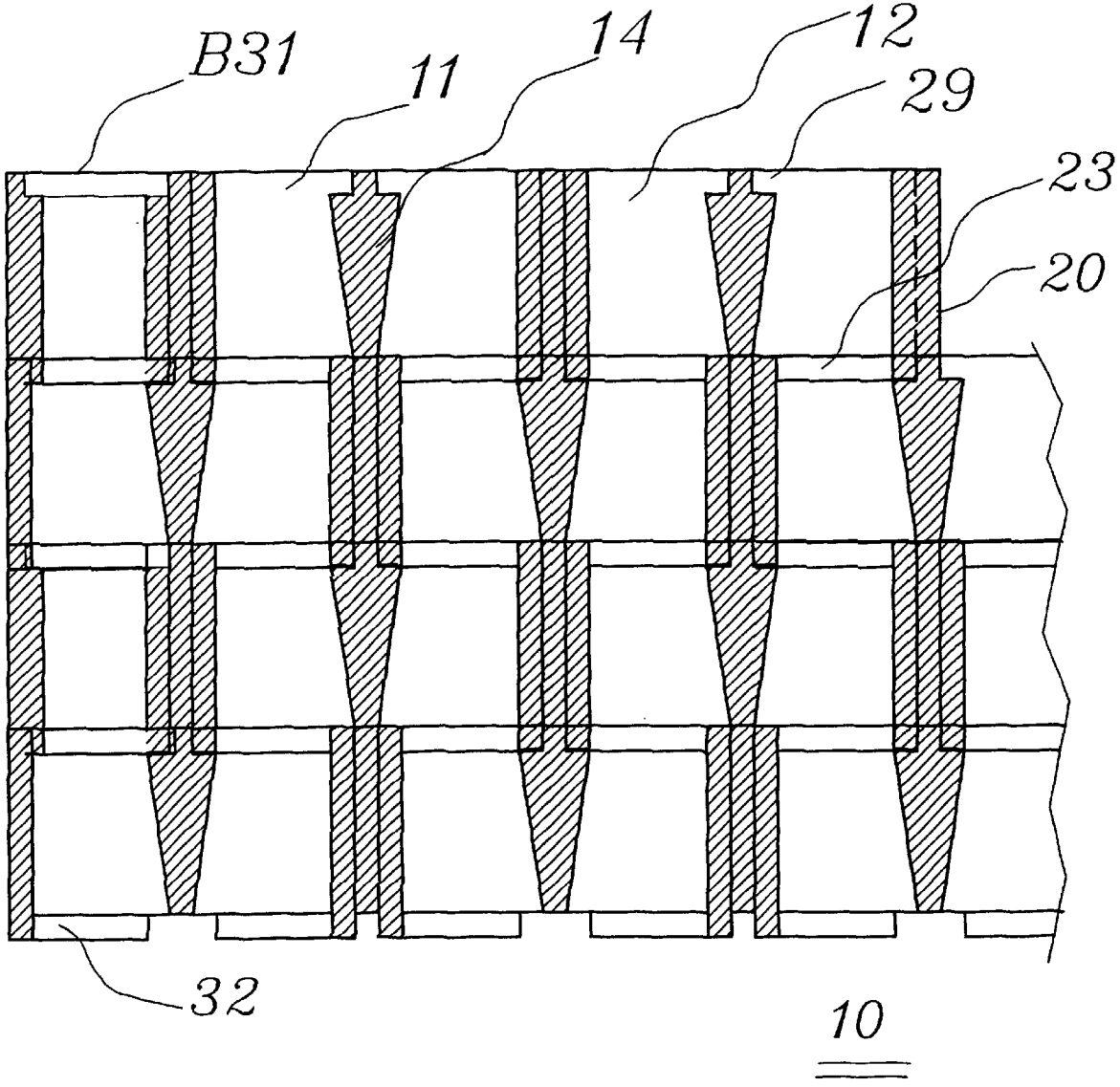
FIGS. 10 and 11 are yet further embodiments of the invention which may be used in association with corners of walls constructed with the block of FIG. 1.
Figure 11:
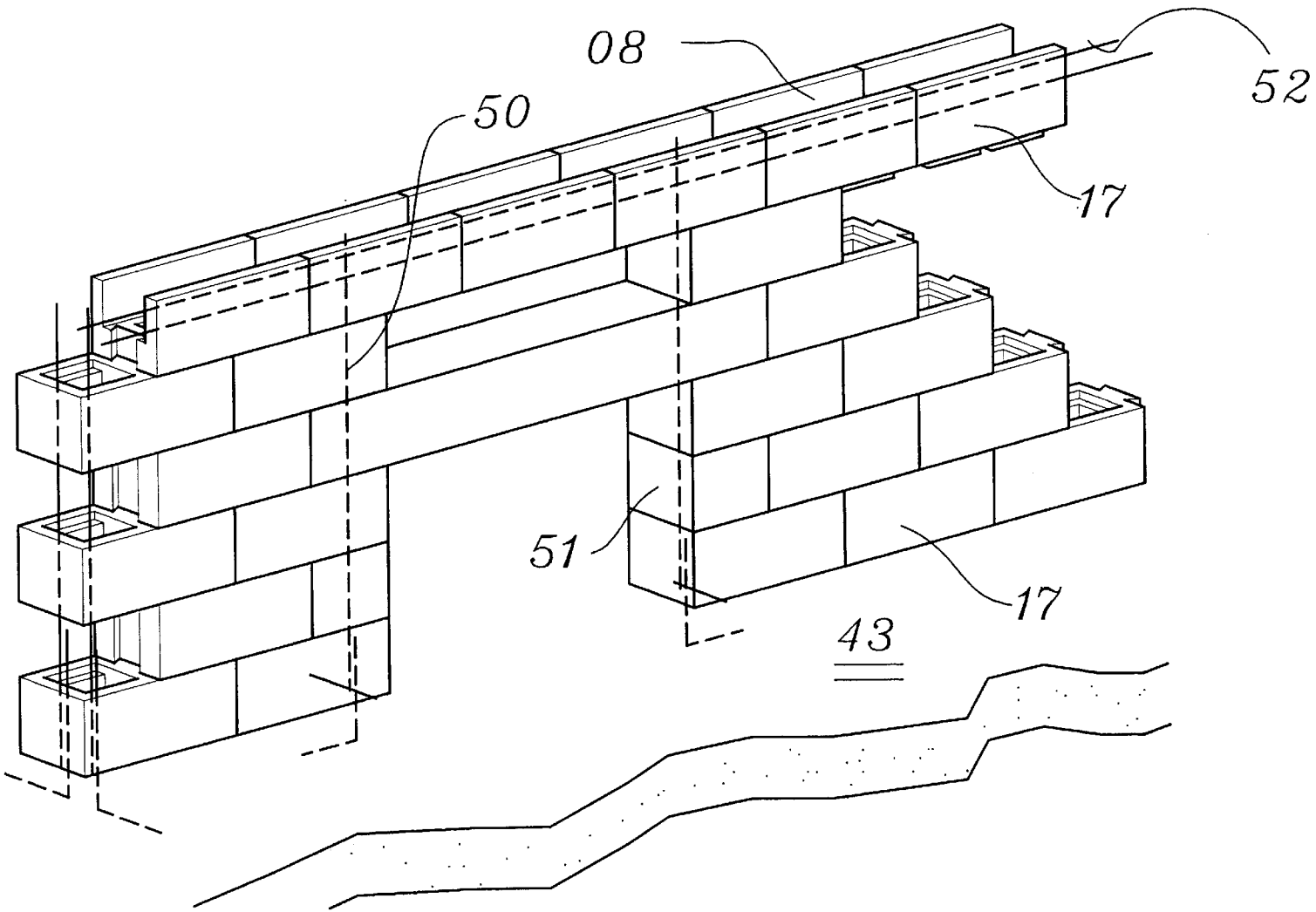

FIGS. 10 and 11 show partial left and right blocks 210 and 310 usable with the present invention in the manner shown in FIG. 9.

Figure 12:
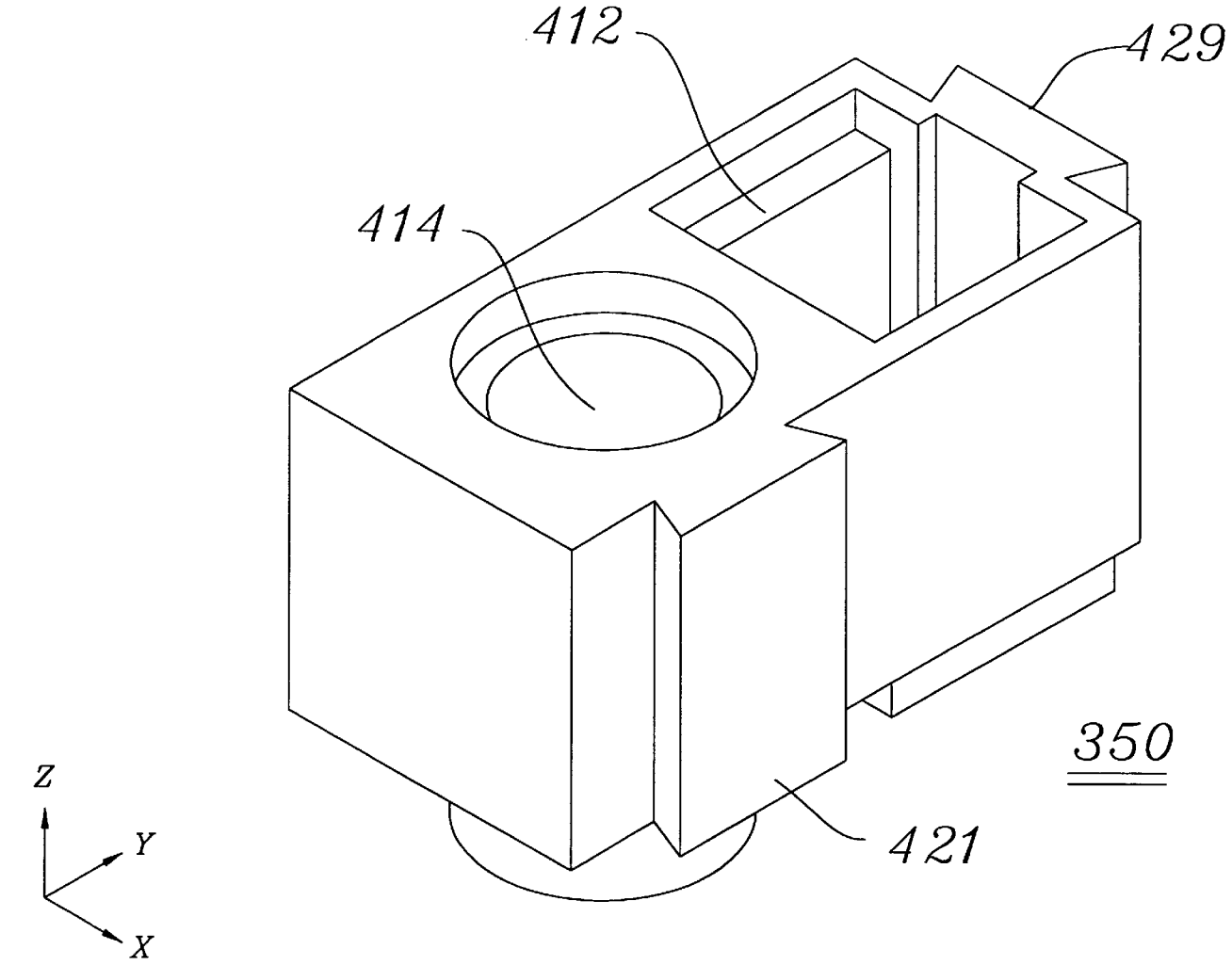
FIG. 12 shows a further embodiment useful in the construction of non-right angle wall corners.

The block 350 of FIG. 12 is employed in non-right angle corner structures.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention what I claim as new, useful and non-obvious and, accordingly, secure by Letters Patent of the United States is:

1. A constructional component for a wall structure definable in an xyz Cartesian coordinate system, capable of resisting high gravity and lateral loads, both uniform and cyclical, the component comprising:

a solid building block, formed of a structural material, having a generally rectangular exterior configuration definable in said xyz Cartesian system, an x-axis thereof comprising a width axis of said wall structure, a y-axis thereof comprising the directionality of said wall structure, and a z-axis thereof comprising a vertical axis of the wall structure, in which one xz end surface of each building block comprises a positive y-axis deep key geometry and each opposing xz end surface thereof comprises a negative y-axis deep key geometry complementally interlockable to said positive geometry of said opposite yz surface, in which a ratio of the x-axis width of a base of each positive and negative deep key geometry of each opposing xy end surface comprises about at least fifty percent of the entire x-axis width of each block, in which each y-axis deep key dimension of said respective positive and negative deep key geometries also comprises a range of about eight to about twenty five percent of the x-axis dimension of said block, in which said block includes a plurality of vertical cavities extending the entire z-axis length therethrough, said cavities separated by a web portion having respective non-parallel opposite vertical surfaces which narrow in the negative z-axis direction, said cavities including rectilinear interior ledges at their respective interfaces with respective top and bottom xy surfaces of said block, said ledges comprising respectively negative and positive complementally interlockable rectilinear structures, each having a z-axis dimension in a range of about five to about twenty five percent of the x-axis dimension of the block, whereby a substantially rigid and load-resistant interlock between horizontally and vertically contiguous blocks, when joined as a component of a wall structure, is resultant therefrom.

2. The constructional component as recited in claim 1 in which said ledges of said vertical cavities comprise three-sided offsets in which no ledge exists at a fourth side of each cavity.

3. The constructional component as recited in claim 1, in which said negative deep key geometry of said xz surface comprises an inward trapezoid.

4. The constructional component as recited in claim 1, in which said negative deep key geometry of said xz surface comprises an outward trapezoid.

5. The constructional component as recited in claim 1, in which said vertical cavities comprise hollow rectilinear cavities.

6. The constructional component as recited in claim 1, in which said cavities comprise cylindrical hollow cavities.

7. The constructional component as recited in claim 2, in which said vertical cavities comprise rectilinear cavities.

8. A constructional component for a wall structure definable in an xyz Cartesian coordinate system, capable of resisting high gravity and lateral loads, both uniform and cyclical, the component comprising:

a solid building block, formed of a structural material, having a generally rectangular exterior configuration definable in said xyz Cartesian system, an x-axis thereof comprising a width axis of said wall structure, a y-axis thereof comprising the directionality of said wall structure, and a z-axis thereof comprising a vertical axis of the wall structure, in which one xz end surface of each building block comprises a positive y-axis deep key geometry and in which one yz surface of each block also comprises a positive x-axis deep key geometry, in which a ratio of a greatest x-axis width of a base of each positive deep key geometry of said xz and yz surfaces comprise about at least fifty percent of the entire x-axis width of each block, in which each y-axis deep key dimension of said deep key geometries also comprises a range of about eight to about twenty five percent of the x-axis dimension of said block, in which said block includes a plurality of vertical cavities extending the entire z-axis length therethrough, said cavities separated by a web portion having respective non-parallel opposite vertical surfaces which narrow in the negative z-axis direction, said cavities including rectilinear interior ledges at their respective interfaces with respective top and bottom xy surfaces of said block, said ledges comprising respectively negative and positive complementally interlockable rectilinear structures, each having a z-axis dimension in a range of about five to about twenty five percent of the x-axis dimension of the block, whereby a substantially rigid and load-resistant interlock between horizontally and vertically contiguous blocks, when joined as a component of a wall structure, is resultant therefrom.

* * * * *